United States Patent [19]

Middleditch

[11] 4,350,331

[45] Sep. 21, 1982

[54] SHEET COUNTING APPARATUS

[75] Inventor: Stanley W. Middleditch, Hayling Island, England

[73] Assignee: De La Rue Systems Limited, London, England

[21] Appl. No.: 100,458

[22] Filed: Dec. 5, 1979

[30] Foreign Application Priority Data

Dec. 8, 1978 [GB] United Kingdom ..... 47672/78

[51] Int. Cl.[3] ..... B65H 3/12

[52] U.S. Cl. ..... 271/95; 235/98 R

[58] Field of Search ..... 235/99 R, 92 SB, 98 R–98 C; 271/4, 95, 98 C, 187; 221/7, 211

[56] References Cited

U.S. PATENT DOCUMENTS 3,944,210 3/1976 McInerny ..... 271/4

3,953,022 4/1976 Oshima ..... 271/95

FOREIGN PATENT DOCUMENTS 1243785 8/1971 United Kingdom .

1371100 10/1974 United Kingdom .

*Primary Examiner*—L. T. Hix

*Assistant Examiner*—Benjamin R. Fuller

*Attorney, Agent, or Firm*—Frost & Jacobs

[57] ABSTRACT

The invention relates to apparatus for counting flexible sheets comprising a support surface (15) for supporting a stack of sheets on edge including a rotary sheet removing assembly (5) mounted on an axis disposed at right angles to said support surface. The assembly includes a plurality of rotary suction organs (6) which are adapted to contact a side face of the free end of the stack and to deflect each sheet from its initial position and count it. The deflecting and counting is accomplished through the sequential application of vacuum to each of the organs during rotation of the assembly.

To align the stack of sheets automatically on the sheet support surface it is set at acute angle to the vertical.

A second support surface (16) is arranged at right angles to said first surface and at lower end of it, the second support surface being of arcuate configuration.

The acute angle is between 20° and 70°, and preferably 45°.

5 Claims, 2 Drawing Figures

SHEET COUNTING APPARATUS

Figure 1:
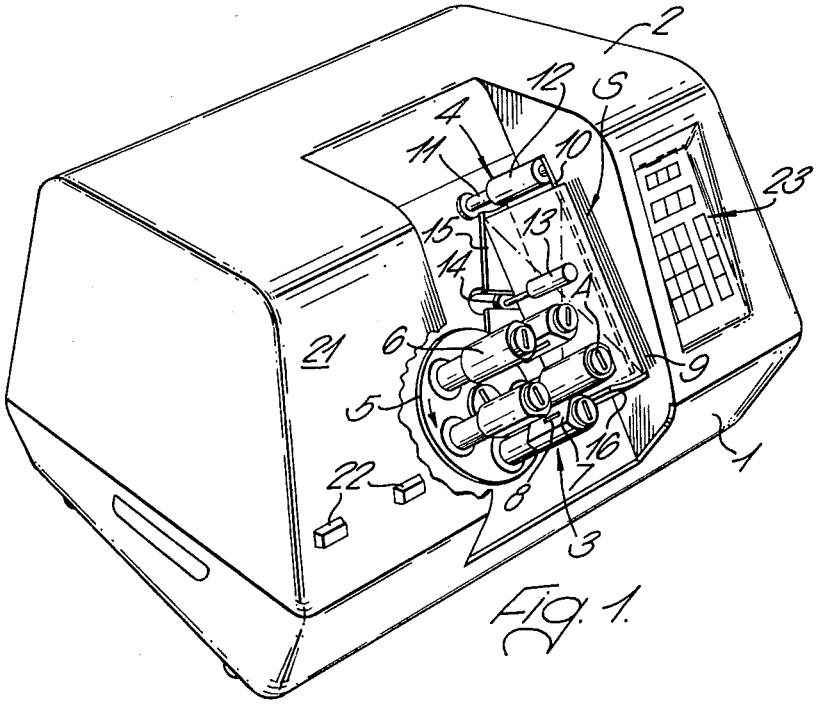

This invention relates to apparatus for counting flexible sheets contained in a stack, for example, a pile of banknotes. More specifically the invention relates to apparatus of the type comprising a support surface for supporting a stack of sheets on edge, means for clamping one end of the stack, and a rotary sheet-removing assembly mounted on an axis disposed at a right-angle to said support surface, said assembly including a plurality of rotary suction organs which are adapted to contact a side face of the free end of the stack and to deflect each sheet from its initial position and to count it, the deflecting and counting being accomplished through the sequential application of vacuum to each of the organs as the assembly rotates. Such apparatus is hereinafter referred to as being "of the type described". Examples of such apparatus are disclosed in British Pat. Nos. 1,243,785 and 1,371,110.

In known constructions of appartus "of the type described" the axes of the rotary sheet handling assemblies are disposed vertically and the stacks of sheets are arranged on-edge upon horizontal support surfaces. Such apparatus necessarily relies upon the competence and care of the operator to pre-position a stack upon the support surface so that it assumes an optimised predetermined position with respect to the position of the rotary assembly. It is known to provide a vertically disposed plate, known as a lay-plate, at the end of, and at right-angles to, said surface to facilitate longitudinal location of the stack prior to actuation of the clamping means. However, it has been found in practice that when the apparatus is used in a highly repetitive manner, for example, to check the contents of straps of banknotes delivered from the finishing line of a banknote printing installations, the short time interval between counts together with operator fatigue, create a tendency to incorrect placement and consequential inaccurate counting.

To facilitate high-speed counting various known devices have been applied to the apparatus. For example, British Pat. No. 1,371,100 discloses a powered actuator to open the clamping means for the stack, in conjunction with a spring-powered closure means and a power-assisted gripping means. Furthermore, said patent also discloses a push-button operated START switch means which effectively serves to release the opened clamp means, and upon closure of the clamp to activate the gripping means, and to initiate operation of the counting means.

Additionally, it is known to provide an electrical switching means, actuable by contact from two adjacent side edges of a stack of sheets when correctly positioned for counting, to actuate the clamping means. A specific example of such an arrangement is provided in an analogous type counting machine manufactured by the Applicant and sold under the trademark "SHEETMASTER". This machine includes a horizontal platform to support the lower planar face of a stack, a pair of vertical panel members adapted to abut adjacent side edges of the stack, each said panel including a stack-sensing switch and being disposed on either side of a rotary vacuum disc sheet deflector, together with a powered clamping foot to descend upon the upper planar face of the stack. In operation, a stack is placed upon the platform and manually moved to abut both of said panel members thereby to close said switches and to actuate the clamping foot. This arrangement effectively assures that the stack is correctly aligned before counting commences and eliminates the need for a manually operable START switch.

It is therefore the prime object of the present invention to provide an improved sheet counting apparatus "of the type described", in which a stack presented thereto is correctly aligned automatically on the sheet support means prior to clamping.

It is a further object to provide the said apparatus with an electrical switching means which renders operative a sheet clamping means after the said alignment has been attained.

A still further object of the invention is to provide the apparatus with an ergonomically superior facility of the loading, clamping and removing of stacks of sheets.

According to one aspect of the present invention there is apparatus for counting flexible sheets comprising a support surface for supporting a stack of sheets on edge, including a rotary sheet removing assembly mounted on an axis disposed at right angles to said support surface, said assembly including a plurality of rotary suction organs which are adapted to contact a side face of the free end of the stack and to deflect each sheet from its initial position and count it, the deflecting and counting being accomplished through the sequential application of vacuum to each of the organs as the assembly rotates, said apparatus comprising a support surface for supporting a stack of sheets on edge in which the support surface is set at an acute angle to the vertical whereby when the stack of sheets are placed on the support surface they align themselves automatically on the sheet support surface.

According to another aspect of this invention sheet counting apparatus of the type described is characterized (a) in that the axis of said rotary sheet removing assembly is disposed at an acute angle with respect to the vertical and in a direction towards a frontal extremity of the apparatus (i.e. towards an operator); (b) in that the sheet clamping means is disposed in such a manner that the free end of a stack of sheets secured thereby is also directed towards said frontal extremity, and (c) by the provision of a second sheet support surface to support said free end of said stack. The said acute angle may be between 20° and 70° but we have found that an angle of approximately 45° is particularly suitable.

Preferably said second sheet support surface is of arcuate configuration as viewed in a direction parallel to said axis. Conveniently it is mounted to the apparatus in an adjustable manner so that its placement with respect to said clamping means can be varied.

Preferably said clamping means comprises a first pivotably mounted member adapted to engage the side face of the stack remote from said rotary assembly, in conjunction with a second pivotally mounted member adapted to engage a part of the opposite face; said members being spring-biassed towards each other.

Preferably powered means and control means therefor are provided relatively to separate said first and second clamping members to permit the insertion of a stack of sheets.

Preferably switch means, operable by the placement of a stack upon the support surface, is provided to effectively actuate said clamping means. The switch means may be of any convenient type providing that it is capable of operation solely by the presence of a stack of sheets. It may be an optical or proximity type switch, but we have found that a light-force electrical switch having an operating blade incorporated above the working surface of the support and capable of being actuated by the weight of a stack, is particularly suitable.

Preferably a delay means is provided to delay the effective actuation of the clamping means upon detection of a stack by said switch means to ensure that the stack is gravitationally positioned against said second support surface.

Figure 2:
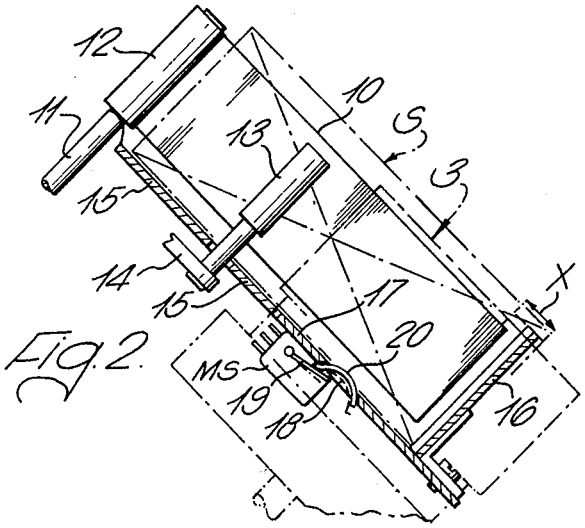

In the accompanying drawings:

FIG. 1 is a partially cut-away frontal perspective view of a banknote counting apparatus embodying the invention; and FIG. 2 is a schematic side elevation of a part of the mechanism shown in FIG. 1.

The mechanism of the apparatus is contained within the boundary of a casing comprising a base portion 1 and a detachable cover portion 2. The base portion 1 is adapted to mount a rotary sheet-removing assembly, generally indicated by symbol 3, and a sheet clamping assembly, generally indicated by symbol 4. The assemblies 3 and 4 are well known per se and an example of them is illustrated in British Pat. No. 1,371,100. Briefly, the rotary assembly comprises a disc 5 driven in counter-clockwise direction by means of a geared electric motor. The disc 5 is mounted on a tubular stationary stub-shaft, one end of which is attached to the base portion 1 and in communication with a source of vacuum. The disc is axially drilled to form bearings for five rotary sheet-removing suction organs 6 which are disposed on axes parallel to the stub-shaft. The suction organs 6 are driven in a clockwise direction about their respective axes by means of a planetary gearing system (not shown) as the disc 5 rotates. The distribution of suction and the phasing of rotation of the rotary components is such that the port face of suction organ A is directed towards the front face of the free end 9 of a stack of banknotes S at the commencement of a sheet counting cycle. Thereafter the free end of the frontmost banknote is removed by the suction organ and during rotation of the assembly it is conveyed across the assembly, counted and released after approximately 90° movement of the disc 5. The following banknotes are handled in a similar manner until a predetermined quantity or all of the contents of the stack has been conveyed through the rotary assembly and counted.

The sheet clamping assembly briefly comprises a feed plate, shown by the dotted lines 10 in FIG. 1, which is mounted on a shaft 11 by a boss member 12. The stack of banknotes S is held against the feed plate 10 by a cylindrical clamping bar 13 which is mounted on a lever 14 in turn mounted co-axially, but freely, about the lower end of the shaft 11 (not visible in the drawing). The feed plate 10 and the clamping bar are biassed together thereby to grip the stack S, by means of a mutually arranged spring system (not shown, but of the type shown in British Pat. No. 1,371,100). An adjustable stop means is provided to prevent counter-clockwise rotation of the lever 14 beyond the position shown and a further stop means is provided to prevent clockwise rotation of the feed plate thereby to prevent contact between the latter and the suction organs at the termination of a counting operation.

The supporting means for the stack comprises a flanged surface 15 disposed at a right-angle to the feed plate and integral therewith, to locate the longitudinal (i.e. major) side edge of the stack of banknotes, in conjunction with an arcuate lay-plate 16 fixedly mounted to the apparatus to locate the end edge of the stack. Accordingly, when a stack is in abutment with the surface 15 and the lay-plate 16, it is correctly aligned with respect to the rotary assembly 3. It should be noted that the surface 15 is provided with an entry slot to permit movement of the clamping bar assembly 13, and furthermore that a static plate member 17 (see FIG. 2) is provided between the surface 15 and the lower edge of the lay-plate 16 to support the stack.

It will thus be appreciated that by means of the angled disposition of the support means a stack of banknotes presented to the apparatus will be aligned automatically by gravitational means.

Feed is effected by means of a light-force tension spring (not illustrated) which serves to rotate the clamping assembly, together with the stack of banknotes in a clockwise direction.

Prior to the insertion of a stack of banknotes in the clamping means a vacuum bellows (not shown) is arranged to turn the feed plate temporarily in a counter-clockwise direction. The explicit arrangement of this bellows and an electromagnetic air flow valve for controlling the same are fully described in the British Pat. No. 1,371,100, but for the purpose of the present invention it is only necessary to say that the completion of an electric circuit energises the valve, which admits vacuum to the bellows and which in turn opens the clamping means. Conversely, deenergization of the said valve admits atmosphere air to the bellows and the clamp is closed by spring force.

Incorporated within the static support surface 17 (see FIG. 2) there is provided a rectangular aperture 18 behind which is disposed a light-force rotary micro-switch MS. The switch is provided with an operating lever 19 to which is attached a convex bladed member 20 of metallic strip material arranged to protrude through the aperture end and above the planar surface of the static support 17. The switch MS is connected electrically with the above-mentioned electromagnetic air flow valve and is so arranged that a stack of banknotes deposited upon the static support 17 actuates the switch and after a predetermined time delay admits atmospheric air to the clamp-opening bellows and the stack is gripped in its correct position by spring pressure. The said time delay may be effected by throttling the vacuum supply to the bellows, by means of an R/C network, by a slugged relay or, more preferably, by a programmed micro-processor which also serves to control the overall sequence and counting of the apparatus.

The cover portion 2 of the casing is provided with an inclined face 21 which incorporates various control switches 22 and an input panel 23 which includes, inter alia, a numerical keyboard and various digital displays.

We have ascertained that the position of the concave face of the lay-plate 16, with respect to the effective pick-up positions of the suction organs, materially effects the performance of the apparatus especially when handling banknotes of variable quality. In the above described example, the lay-plate is fixedly mounted to the baseplate of the apparatus at an average position to enable it to handle most currencies in a reasonable satisfactory manner. However, the performance of the apparatus may be optimized to handle a particular currency by means of an operator-adjustment which serves to position the lay-plate at a predetermined incremental position between the limits indicated by the double arrow X. The said adjustment may be effected, for example, by mounting the lay-plate in a slidable manner and controlling its movement by a lever calibrated in accordance with the relative hardness or quality of the banknote paper, through the medium of a stepped cam, or analogous means.

It will thus be seen that by means of the above described invention repetitive batch counting of banknotes may be rapidly and efficiently effected and that problems associated with inaccurate clamp loading have been eliminated. Furthermore, it will be appreciated that the angled layout of the mechanism has enhanced operation of the appartus from the ergonomic aspect and also that the automatic clamp closing means effectively reduces operator fatigue.

I claim:

1. Apparatus for counting flexible banknotes contained in a stack, said apparatus being of a type comprising a first support surface for supporting a stack of banknotes on edge, means for clamping one end of the stack, and a rotary banknote removing assembly mounted on an axis disposed at a right-angle to said support surface, and in which said banknote removing assembly includes a plurality of rotary suction organs which are adapted to contact a side face of the free end of the stack and to deflect each banknote from its initial position and to count it, the deflecting and counting being accomplished through the sequential application of vacuum to each of the organs as the assembly rotates, said apparatus being characterized (a) in that the axis of said rotary banknote removing assembly is disposed at an acute angle with respect to the vertical and in a direction towards a frontal extremity of the apparatus (i.e. towards an operator); (b) in that the banknote clamping means is disposed in such a manner that the free end of a stack of banknotes secured thereby is also directed towards said frontal extremity; (c) by the provision of a second banknote support surface disposed at right angles to said first support surface for supporting said free end of said stack, and (d) that said second support surface is of arcuate configuration as viewed in a direction parallel to said axis.

2. Apparatus according to claim 1 in which said acute angle is between 20° and 70°.

3. Apparatus according to claim 2 in which the acute angle is approximately 45°.

4. Apparatus according to claim 1 and in which the second sheet support surface is mounted on the apparatus in an adjustable manner so that its placement with respect to the axis of the sheet-removing assembly can be varied.

5. Apparatus according to claim 1 including switch means for activation of said clamping means, said switch means being operable by a stack on said first support means, and means for delaying activation of said clamp means on operation of said switch means for a time period sufficient to allow movement of said stack from its switch-operating position into abutment with both of said support surfaces.

* * * * *